US008847870B2

(12) United States Patent
Lapidus et al.

(10) Patent No.: US 8,847,870 B2
(45) Date of Patent: Sep. 30, 2014

(54) VOLTAGE CONVERSION APPARATUS SUITABLE FOR A PIXEL DRIVER AND METHODS

(75) Inventors: Peter Lapidus, Boulder, CO (US); David Hollenbeck, Longmont, CO (US); Ronald Hathcock, Longmont, CO (US)

(73) Assignee: Citizen Finetech Miyota Co., Ltd., Nagano (JP)

( * ) Notice: Subject to any disclaimer, the term of this patent is extended or adjusted under 35 U.S.C. 154(b) by 301 days.

(21) Appl. No.: 13/283,010

(22) Filed: Oct. 27, 2011

(65) Prior Publication Data

US 2013/0106825 A1 May 2, 2013

(51) Int. Cl.
*G09G 3/36* (2006.01)
*G09G 5/00* (2006.01)

(52) U.S. Cl.
CPC ... *G09G 3/36* (2013.01); *G09G 5/00* (2013.01)
USPC ..... 345/98; 345/204; 345/211

(58) Field of Classification Search
USPC ..... 345/87–108, 204–212; 359/290–303; 365/189.2, 189.11
See application file for complete search history.

(56) References Cited

U.S. PATENT DOCUMENTS

| | | | | |
|---|---|---|---|---|
| 5,798,746 | A * | 8/1998 | Koyama | 345/98 |
| 6,747,886 | B1 | 6/2004 | Morikawa | |
| 7,359,272 | B2 | 4/2008 | Wang et al. | |
| 7,592,990 | B2 * | 9/2009 | Miyazawa | 345/90 |
| 7,710,796 | B2 | 5/2010 | Cottier et al. | |
| 2002/0051096 | A1 * | 5/2002 | Yamazaki et al. | 348/771 |
| 2002/0140642 | A1 * | 10/2002 | Okamoto | 345/76 |
| 2003/0098711 | A1 * | 5/2003 | Tsuboi et al. | 326/81 |
| 2004/0125090 | A1 * | 7/2004 | Hudson | 345/204 |
| 2004/0263502 | A1 * | 12/2004 | Dallas et al. | 345/204 |
| 2005/0151706 | A1 * | 7/2005 | Lifka et al. | 345/76 |
| 2007/0274140 | A1 * | 11/2007 | Joshi et al. | 365/189.11 |
| 2008/0225193 | A1 * | 9/2008 | Katayama et al. | 349/40 |
| 2011/0085371 | A1 | 4/2011 | Wang | |
| 2011/0175538 | A1 | 7/2011 | Wang | |

* cited by examiner

*Primary Examiner* — Hong Zhou

(57) ABSTRACT

Apparatus and methods are disclosed that can provide for voltage translation and conversion that can be applied, as an example, in a microdisplay including a plurality of pixels that are driven at a pixel drive voltage. A pixel is configured to receive a lower pixel drive voltage for one state of the pixel and an upper pixel drive voltage for an opposite state of the pixel. A memory circuit selectively couples the pixel to the lower voltage and the upper pixel drive voltage in response to control signals operable between the lower voltage and an intermediate voltage level that is less than the upper pixel drive voltage.

1 Claim, 4 Drawing Sheets

VOLTAGE CONVERSION APPARATUS SUITABLE FOR A PIXEL DRIVER AND METHODS

BACKGROUND

Embodiments of the present invention are generally related to the field of voltage converters and, more particularly, to the field of a voltage converter and methods that are suitable at least for use in a display system.

Generally, the pixels of a field sequential display such as, for example, a ferroelectric liquid crystal on silicon (FLCOS) display require the selective application of a pixel drive voltage to switch the liquid crystal material of the display between different polarization states. In order to access the pixels of the display, the pixels can be selected based on a word line architecture, with program and read operations for individual pixels being carried out using one or more bit lines. Thus, drive circuitry is associated with each pixel for providing an appropriate value of pixel drive voltage to the pixels. Conventional field sequential display systems have adopted the practice of operating the circuitry of the display, including word line drivers and sense amps using the pixel drive voltage to represent an upper logic state. Applicants recognize, however, that the adoption of this practice introduces concerns, as will be further discussed below.

The foregoing examples of the related art and limitations related therewith are intended to be illustrative and not exclusive. Other limitations of the related art will become apparent to those of skill in the art upon a reading of the specification and a study of the drawings.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiments shown, but is to be accorded the widest scope consistent with the principles and features described herein including modifications and equivalents, as defined within the scope of the appended claims.

It is noted that the drawings are not to scale and are diagrammatic in nature in a way that is thought to best illustrate features of interest. Descriptive terminology may be adopted for purposes of enhancing the reader's understanding, with respect to the various views provided in the figures, and is in no way intended as being limiting.

Figure 1:
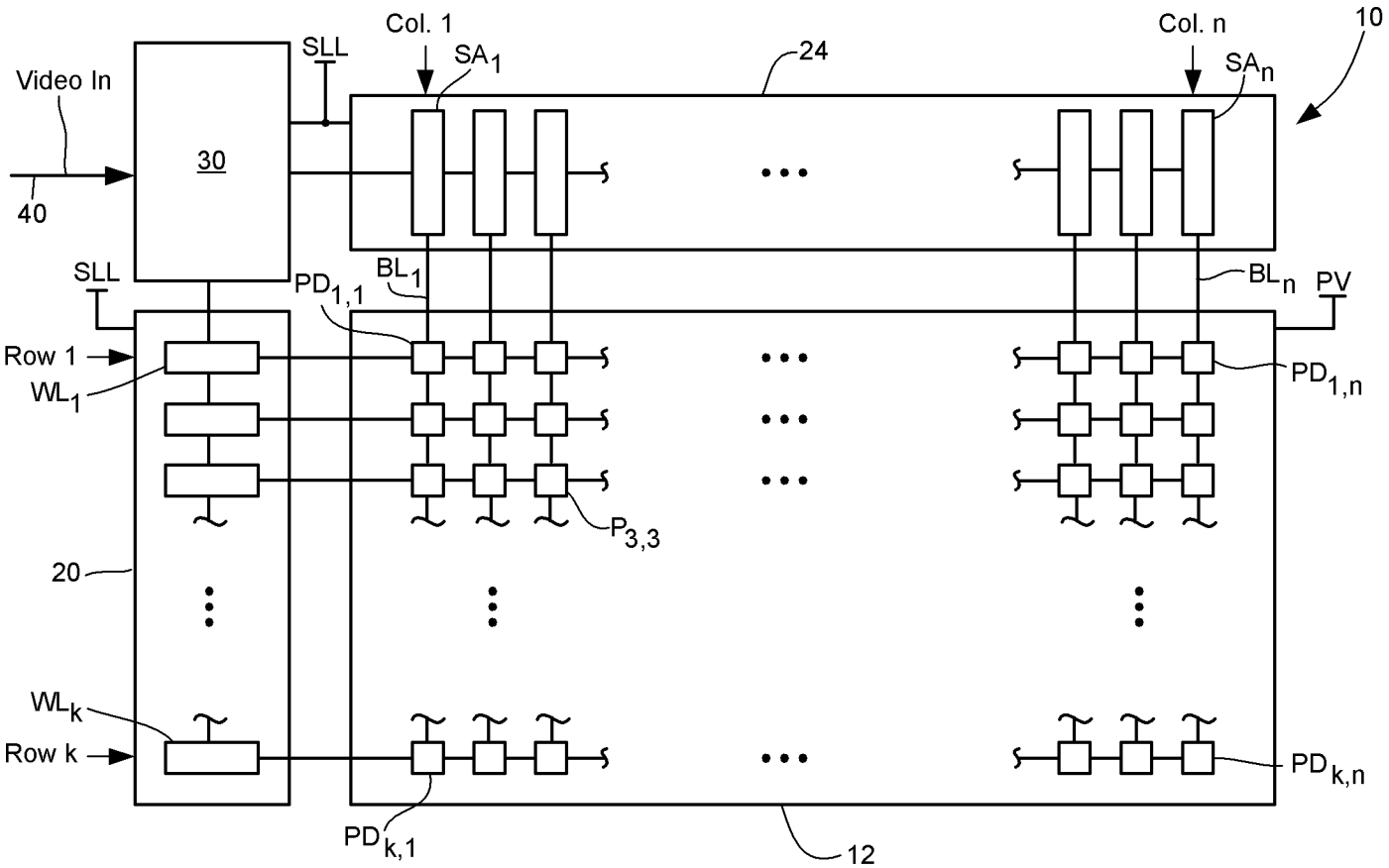
FIG. 1 is a diagrammatic plan view and partial block diagram illustrating a display system that utilizes voltage conversion and shifting according to the present disclosure and by way of non-limiting example.

Attention is now directed to the figures wherein like items may refer to like components throughout the various views. FIG. 1 is a block diagram representation of a display system, produced according to an embodiment of the present disclosure, and generally indicated by the reference number 10. System 10 includes a display 12 such as, for example, an FLCOS sequential microdisplay, however, any suitable type of display or other electronic device/system may be utilized so long as the teachings herein are employed. In this regard, one of ordinary skill in the art, with this overall disclosure in hand, will appreciate that the voltage conversion technology that is described herein can readily be adapted to other suitable environments, devices and systems which benefit from voltage conversion and is not limited to display technology applications.

Display 12 includes a pixel array that is made up of k rows and n columns. Pixel drivers are shown in the display designated using the letters PD with an associated subscript. Thus, the pixel driver for pixel 1,1 is designated as $PD_{1,1}$. Selected other pixel drivers are explicitly designated including $PD_{1,n}$, $PD_{1,k}$ and $PD_{3,3}$. A word line driver section 20 includes word line drivers that are designated as $WL_1$-$WL_k$ such that each word line driver can select one row of pixels in the display. A sense amp section 24 includes sense amps $SA_1$-$SA_n$. Each sense amp can be electrically connected to an associated set of bit lines $BL_1$-$BL_n$. Specific design details with respect to the embodiment of the pixel driver can determine whether the bit line set is made up of a single bit line, BL, or a pair of bit lines including BL clear and BL set that can be digital opposites with respect to one another. A controller 30 provides for coordinated operation of the word line drivers and sense amps for purposes of programming and reading the memory cells of the pixel array. In an embodiment, controller 30 can be configured for processing an incoming video stream on an input 40 to generate drive signals for word line section 20 and sense amp section 24.

Figure 2:
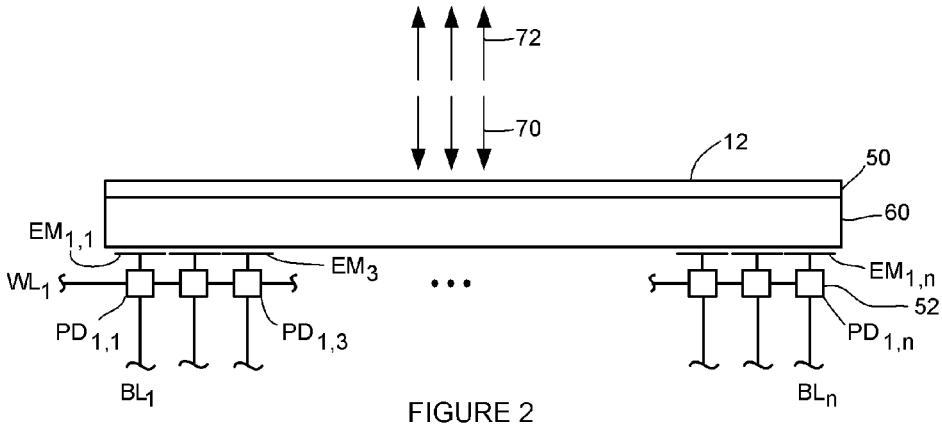
FIG. 2 is a diagrammatic view, in elevation, of the display system of FIG. 1, shown here to illustrate further details with respect to its structure and operation.

FIG. 2 is a diagrammatic illustration of display 12 in an elevational view. The display can include a layer 50 of a cover glass. A row 52 of pixel drivers, arbitrarily selected as row $PD_{1,1}$-$PD_{1,n}$, is illustrated having each pixel driver electrically connected to one of a row of electrode mirrors that are designated as $EM_{1,1}$-$EM_{1,n}$. A layer 60 of liquid crystal material is sandwiched between cover glass 50 and the electrode mirrors. Depending on the voltage state that is applied to each electrode mirror by its associated pixel driver, polarized incoming light 70 can be selectively reflected and modulated as output light 72 to maintain its input polarization or to cause the liquid crystal layer to rotate the polarization to a crossed polarization. In a display system, one polarization of polarization modulated output light 72 can then be passed for viewing, for example, by a polarization beam splitting cube (not shown), while the other polarization of modulated output light 72 can be rejected. Thus, reference to turning a pixel on or turning a pixel off refers to the appropriate application of a voltage to the pixel to result in an appropriate polarization state of emitted light. Pixel driver row 52 is selected via word line $WL_1$ and bit line sets that are designated as $BL_1$-$BL_n$.

Each bit line set can be made up of a single bit line BL or a pair of bit lines that can be referred to as a clear bit line (designated as BLCLR) and a set bit line (designated as BLSET).

Figure 3:
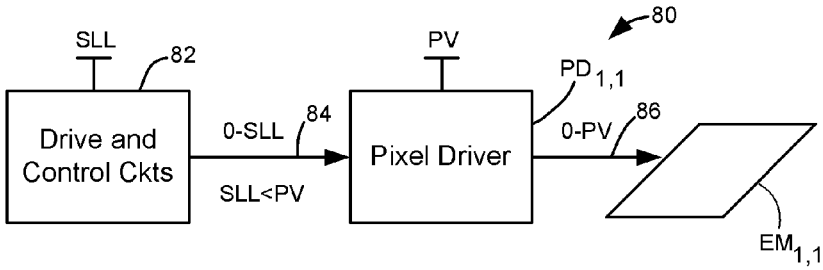
FIG. 3 is a block diagram that illustrates one instantiation of a pixel driver and associated control circuits including input voltages and output levels according to the present disclosure.

FIG. 3 is a block diagram illustrating one instantiation of a pixel driver that is arbitrarily selected as $PD_{1,1}$ from FIGS. 1 and 2 and generally indicated by the reference number 80. The pixel driver drives an associated electrode mirror $EM_{1,1}$. Associated drive circuitry 82 provides drive signals to pixel driver $PD_{1,1}$ that can include, for example, word line selection circuitry and sense amp circuitry. As shown, drive lines 84 from the drive and control circuits to the pixel driver can operate from 0-SLL volts. The term SLL represents a selected, intermediate logic level that will be described in more detail below. It is noted that the intermediate logic level may be referred to interchangeably hereinafter as an intermediate voltage (IV). An electrode mirror driver line 86 operates from 0-PV where PV represents a pixel voltage that is greater than SLL. Thus, pixel driver $PD_{1,1}$ provides a translation (e.g., level shift) from the use of SLL as an upper logic level to the use of PV as an upper logic level, while maintaining drive lines 84 in electrical isolation from the higher pixel voltage PV. As will be further discussed, this pixel driver can allow for converting a significant amount of circuitry to operate based on the lower SLL voltage instead of using pixel voltage PV. One of ordinary skill in the art, with this overall disclosure in hand, can readily adapt the voltage translation arrangement of FIG. 3 and figures yet to be described to other suitable electronic environments that are in need of voltage translation.

Figure 4:
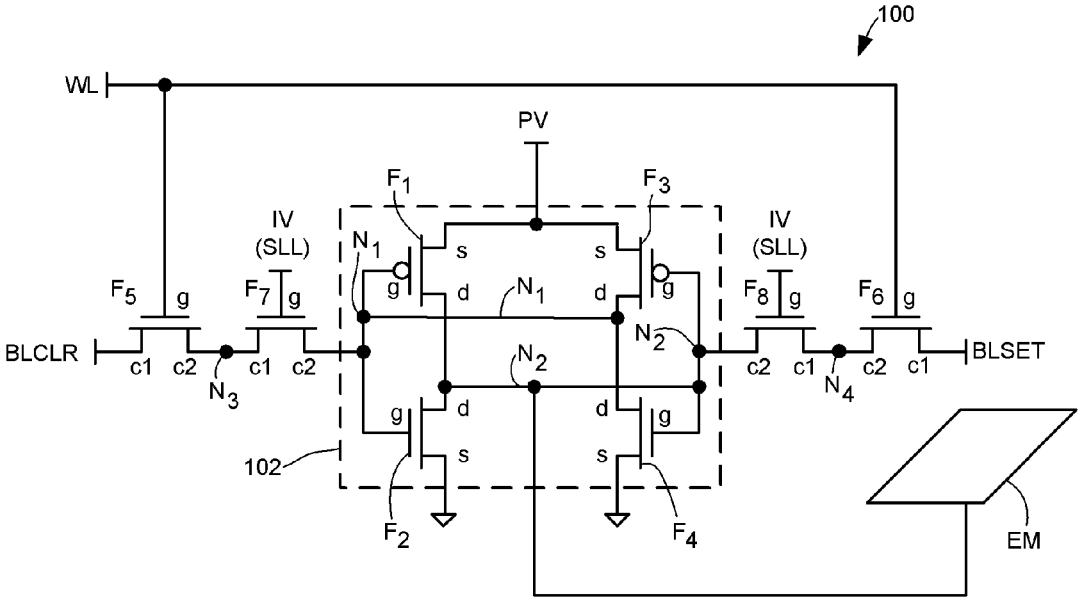
FIG. 4 is a schematic diagram of an embodiment of a pixel driver that can be used in the configurations of FIGS. 1-3.

Attention is now directed to FIG. 4 which is a schematic diagram illustrating an embodiment of a pixel driver, generally indicated by the reference number 100, that can be used for the pixel drivers shown in FIGS. 1-3. Pixel driver 100 includes an inverter core 102, that is shown within a dashed line, and is made of up a pair of cross-coupled inverters. A first inverter includes a pFET $F_1$ and an nFET $F_2$ having interconnected gates to define a node $N_1$. A second inverter includes a pFET $F_3$ and an nFET $F_4$ having interconnected gates to define a node $N_2$. The source terminals of $F_2$ and $F_4$ are connected to ground while the source terminals of $F_1$ and $F_3$ are connected to pixel voltage PV. The drain of $F_1$ is electrically connected to the drain of $F_2$ (at node $N_2$) while the drain of $F_3$ is electrically connected to the drain of $F_4$ (at node $N_1$). Inverter core 102 serves as a latch that is made up of four transistors and is capable of two stable states. In a first state, $N_1$ is at PV while $N_2$ is at zero volts. In a second state, $N_1$ is at zero volts while $N_2$ is at PV. For descriptive purposes, the first state will be considered as the "OFF" state of an associated pixel while the second state will be considered as the "ON" state of the associated pixel, although it is to be understood that this state assignment is arbitrary depending upon the overall configuration of a given display system. Node $N_2$ can be electrically connected to an associated pixel mirror electrode EM such that the pixel electrode mirror can be selectively driven at each voltage of the two stable states. As will be familiar to one having ordinary skill in the art of SRAM memory having cross-coupled inverter cores, switching between the first and second stable states involves the application of external drive signals to nodes $N_1$ and $N_2$. Further, the FETs of the inverter core are configured to maintain a stable state in the absence of external drive signals but to offer no significant resistance to changing states responsive to appropriate external drive signals. For switching states, opposing voltages are applied to the nodes. For example, in the "OFF" state, with $N_1$ at pixel voltage PV and $N_2$ at zero voltage, externally driving $N_1$ at zero volts and $N_2$ at voltage PV will cause the core to switch to the "ON" state wherein $N_1$ is at zero volts and $N_2$ is at voltage PV. In this regard, it should be appreciated that driving node $N_1$ to zero volts is a controlling event since $F_2$ is forced into cutoff while $F_1$ is forced into conduction, thereby causing node $N_2$ to immediately rise in voltage. Conversely, when the inverter core is initially in the "ON" state, driving node $N_2$ to zero volts is a controlling event. Pixel voltage PV is sufficient in magnitude to cause liquid crystal material 60 to switch the polarization of outgoing light 72 to a cross polarization as compared to incoming light 70.

With continuing reference to FIG. 4, it should be appreciated that driving nodes $N_1$ and $N_2$ with external voltages that match a pre-existing state of the nodes will produce no change in the stable state of the inverter core. For purposes of reading inverter core 102 without changing a pre-existing stable state of the core, nodes $N_1$ and $N_2$ can simultaneously be driven at positive voltage and then released. In this way, any capacitances that are associated with the nodes and associated circuitry, yet to be described, can be at least temporarily charged to the positive voltage. Upon release of the simultaneous charging drive voltages, however, one of nodes $N_1$ and $N_2$ will immediately drop in voltage such that the pre-existing state of the inverter core is maintained. The voltage drop can be detected, for example, by sense amp differential monitoring of $N_1$ and $N_2$ to identify the current state of the pixel driver.

Briefly considering the prior art, it should be appreciated that conventional display systems generally adopt pixel voltage PV (see FIG. 2) as a display wide voltage value that represents a digital 1, while zero volts represents a digital 0. In such a conventional display, bit lines BL and word lines WL toggle between zero volts and pixel voltage PV. Further, the word line drivers and the sense amps in a conventional system are also configured to toggle between zero volts and pixel voltage PV in order to operate the pixel drivers. Thus, the circuitry of all the components of the display system in a conventional system are subject to design rules that specify operation at pixel voltage PV. As will be seen below, Applicants recognize a different approach.

Referring again to FIG. 4, details with respect to externally interfacing pixel driver 100 will now be described. Pixel driver 100 and its associated electrode mirror EM are accessed and controlled using a word line WL and a set of bit lines BLCLR and BLSET wherein the latter two signals can be digital opposites. It should be appreciated, however, that setting both bit lines to a high state has no affect on the current state of the memory cell. The pixel driver includes a pair of interface control nFETs that are designated as $F_5$ and $F_6$. A gate terminal of each of these interface control nFETs is electrically connected to word line WL for selection of the memory cell by applying a word line voltage to the gates of the interface FETs. It is noted that FETs $F_5$ and $F_6$ can be physically symmetrical devices. Therefore, the channel terminals of these FETs have not been designated as source and drain terminals, but rather as c1 and c2 since the behavior of these channel terminals, based on the device symmetry, can be dependent upon the particular voltages that are applied to the nFET. When WL is in a logic low state, FETs $F_5$ and $F_6$ are in cutoff (OFF). On the other hand, when WL is in a logic high state, FETs $F_5$ and $F_6$ can be biased into an ON state, depending on the voltages that are applied to their respective channel terminals. Terminals c2 of nFETs $F_5$ and $F_6$ are electrically connected to respective c1 terminals of a pair of voltage converter nFETs that are designated as $F_7$ and $F_8$. Like nFETs $F_5$ and $F_6$, nFETs $F_7$ and $F_8$ can be physically symmetrical devices and are therefore designated as having a gate terminal and a pair of channel terminals c1 and c2. Gate terminals of nFETs $F_7$ and $F_8$ are biased at voltage SLL designating the Selected Logic Level or intermediate voltage (IV). As described above, the voltage that is selected as IV is less than pixel voltage PV such that a translation (e.g. conversion or shift) is provided between inverter core 102 and the surrounding circuitry that drives the inverter core. In this regard, voltage converter nFETs $F_7$ and $F_8$ serve to isolate interface nFETs $F_5$ and $F_6$, word line driver section 20 (FIG. 1) and sense amp section 24 from the higher pixel voltage PV. Thus, the interface lines comprising WL, BLCLR and BLSET can be active high at a logic level that corresponds to the SLL voltage (IV), as opposed to the higher pixel voltage PV.

Still referring to FIG. 4, the operation of the circuitry will be described in the context of a write operation that toggles the state of the cross-coupled inverter core. When inverter core 102 is initially in the "OFF" state, node $N_1$ is at PV while node $N_2$ is at zero volts. By setting BLCLR to a logic low value (at least approximately zero volts) and BLSET to a logic high value (at least approximately SLL volts) and then setting WL to SLL, the inverter core can be toggled to the "ON" state. The nFET $F_7$ is in cutoff since nFET $F_5$ is in cutoff at least until WL is driven at SLL concurrent with driving BLCLR at zero volts. When BLCLR is applied at c1 of nFET $F_5$ at the logic low level (zero volts) concurrent with the application of SLL applied at the gate of $F_5$ via WL, $F_5$ turns on which causes voltage converter nFET $F_7$ to turn on, with c1 of the nFET serving as a source terminal. Turning on $F_7$ begins pulling node $N_1$ toward ground which biases $F_2$ towards cutoff, quickly turning off $F_2$ while simultaneously biasing $F_1$ into conduction since a relatively low threshold voltage will be exceeded. Switching $F_2$ to the cutoff state and $F_1$ into conduction causes node $N_2$ to rise toward PV. Feedback from pFET $F_3$ and nFET $F_4$ serves to reinforce the state change resulting in $N_1$ at zero volts and $N_2$ at voltage PV. Thus, the change in state, at least insofar as BLCLR is concerned, does not result in any exposure of bit line BLCLR or word line WL to any voltage that is greater than SLL. During the state change under discussion, BLSET at c1 of $F_6$ and WL at the gate of nFET $F_6$ are concurrently driven at the active high voltage (SLL) so as to turn on $F_6$. As node $N_4$ rises in voltage, nFET $F_8$, turns on since the initial zero voltage state of $N_2$ causes channel terminal c2 of $F_8$ to serve as a source terminal. Current flow through $F_6$ and $F_8$ causes node N2 to rise in voltage, contributing at least to some extent to the stable state change in the inverter core. It should be appreciated, however, that as soon as node $N_2$ rises to approximately the value of SLL (at least no more above SLL than a threshold voltage), voltage converter nFET $F_8$ is biased into cutoff. Node $N_2$ can then continue to rise to pixel voltage PV. The nFET $F_8$, however, remains in cutoff such that word line WL and bit line BLSET are isolated from pixel voltage PV. Details with respect to toggling the inverter core from the "ON" state to the "OFF" state have not been provided for purposes of brevity since the descriptions above remain applicable due to the symmetry of pixel driver 100. That is, node voltages for $N_1$ and $N_2$ are reversed as well as voltages applied to BLCLR and BLSET. Isolation converter FETs $F_7$ and $F_8$ serve to isolate word line WL and bit lines BLCLR and BLSET from pixel voltage PV while allowing WL, BLCLR and BLSET to toggle based on the lower, SLL voltage.

Figure 5:
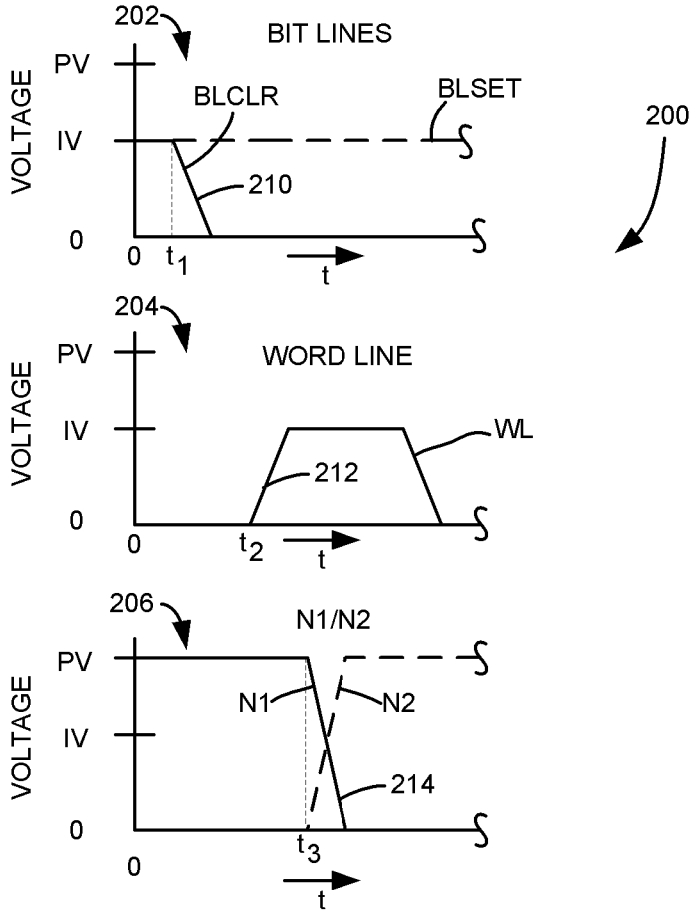
FIG. 5 is an embodiment of a timing diagram illustrating the operation of the pixel driver of FIG. 4.

Attention is now directed to FIG. 5 which is an embodiment of a timing diagram generally indicated by the reference number 200, illustrating aspects of the operation of pixel driver 100 of FIG. 4. It should be appreciated that the various waveforms provided in the timing diagram are intended by way of example for purposes of enhancing the understanding of the reader and are not intended as limiting. The waveforms can vary in any suitable manner while remaining within the scope of the present disclosure. A first plot 202 illustrates bit lines BLCLR and BLSET versus time, a second plot 204 illustrates word line WL versus time and a third plot 206 illustrates output nodes N1 and N2 versus time wherein N2 serves as the output that drives an electrode mirror. Initially, both BLCLR and BLSET are at the intermediate voltage IV, WL is at zero volts, N1 is at pixel voltage PV and N2 is at zero volts. At time $t_1$, BLCLR is driven to zero volts in a transition 210 as applied to c1 of FET $F_5$ (FIG. 4). Transition 210 has no immediate influence on the output since WL is low. At time $t_2$, word line WL is driven from zero volts to intermediate voltage IV in a transition 212. The WL transition causes both $F_5$ and $F_7$ to turn on in FIG. 4. Since BLCLR is low, node $N_1$ is pulled down in a transition 214 that starts at time $t_3$ causing $N_1$ to transition to zero volts and $N_2$ to transition to PV. As noted above, pulling down one of nodes N1 or N2 is a controlling event, which is evident since there is no transition in the state of the BLSET line. Due to the symmetry of the circuitry, the pixel driver operates in the manner of a mirror image with respect to pulling node $N_2$ down from the pixel voltage. Accordingly, descriptions of such a mirror image response have not been provided for purposes of brevity. Based on FIG. 5, it can be observed that the bit lines and word line are operable as control signals between a lower voltage (e.g., zero volts) and an intermediate voltage that is less than the pixel voltage while the output is operable between the lower voltage and the higher pixel voltage.

Having described the operation and structure of pixel driver 100 in detail above, it should be appreciated that word line WL and bit lines BLCLR and BLSET are no longer constrained to toggle based on pixel voltage PV. Moreover, components that drive these lines are no longer required to operate at pixel voltage PV. Referring to FIG. 1, such components include, for example, the word line drivers of word line driver section 20, the sense amps of sense amp section 24 and controller 30. These components, therefore, can be configured for operation based on design rules that are not constrained by requiring an upper voltage value that is equal to pixel voltage PV. Generally, electronic designers can specify what is often referred to as a "core logic voltage" that can be at least generally applicable to all components of a system for purposes of digital operation. A design that is based on the present disclosure can specify the SLL voltage in the manner of such a core logic voltage that is applicable to all components of the system apart from the pixel drivers themselves. Only the pixel drivers need be configured to operate at pixel voltage PV. The core logic voltage can be selected based on design interests including, by way of non-limiting example, reducing operational voltage to correspondingly reduce power consumption and heat generation without significantly compromising reliability, for example, by increasing error rates. Prior art systems often compromised these design interests by operating word line drivers, sense amps and the like at the pixel voltage, based on the driver requirements for the liquid crystal material of the display. In accordance with the present disclosure, SLL can be chosen as significantly less than pixel voltage PV. Operation at the relatively lower SLL voltage can result in smaller silicon footprints for integrated devices such as the word line drivers and sense amps while operating these devices at a reduced power consumption and with reduced heat generation, as compared to operation based on using pixel voltage PV. By way of non-limiting example, the pixel voltage in current, practical displays can have a lower limit of approximately 2 volts, however, pixel voltages of at least 10 volts can be used. The SLL, IV voltage can be in the range from 1 volt to 2 volts, inclusively. In an embodiment, the pixel drive voltage can be 3.6 volts with the SLL voltage selected as 1.8 volts. In view of the present disclosure, any suitable combination of SLL voltage and PV can be used so long as PV is less than the SLL voltage.

Figure 6:
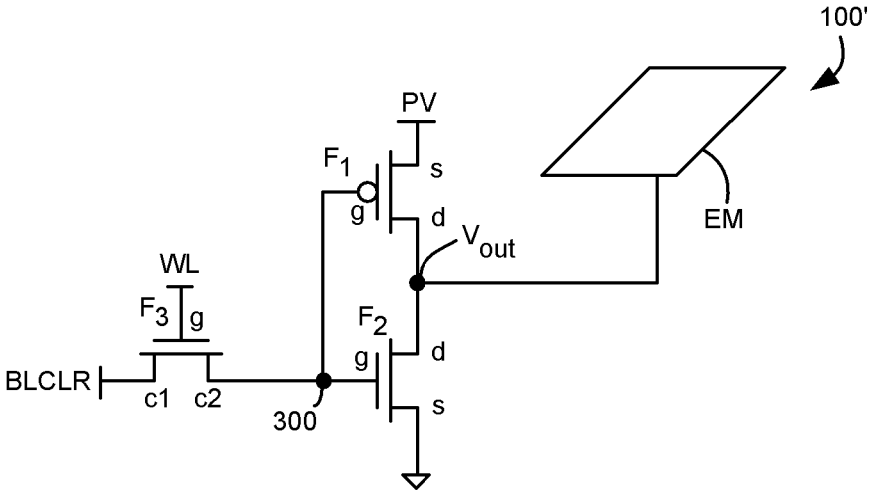
FIG. 6 is a schematic diagram of another embodiment of a pixel driver that can be used in the configurations of FIGS. 1-3.

Attention is now directed to FIG. 6 which is a schematic diagram illustrating another embodiment of a pixel driver, generally indicated by the reference number 100', that can be used for the pixel drivers shown in FIGS. 1 and 2. Pixel driver 100' includes an inverter that is made up of a pair of field oxide transistors that are illustrated as a pFET $F_1$ and an nFET $F_2$. It is noted that field oxide transistors are well known and are characterized by adjusting the gate oxide thickness and channel doping such that the transistor exhibits a desired threshold voltage. In the present example, the gates of $F_1$ and $F_2$ can be formed using either polysilicon or metal. The drain terminals of $F_1$ and $F_2$ are electrically connected as well as the gate terminals. An output $V_{out}$ is electrically connected to the drain terminals and electrode mirror EM. It should be appreciated that a negative $V_{gs}$ voltage on $F_1$, equal to or greater (i.e., more negative) than the threshold voltage is needed to allow $F_1$ to turn on. The source of $F_1$ is electrically connected to pixel voltage PV while the source terminal of $F_2$ is electrically connected to ground. A word line selector nFET $F_3$ is driven by word line WL on its gate terminal and bit line BLCLR on its c1 terminal, which can correspond to the BLCLR line of FIG. 4 and compensates for the state inversion that is produced by the $F_1/F_2$ inverter pair such that electrode mirror EM is driven at pixel voltage PV when BLSET is in a logic high state. The c2 terminal of $F_3$ is electrically connected to the gate terminals of $F_1$ and $F_2$. The threshold of $F_2$ can be set such that the transistor turns on when SLL is applied to its gate via a word line selector nFET $F_3$ which implies that the threshold voltage of $F_2$ is less than SLL but greater than zero volts. In an embodiment, the threshold of $F_2$ can be less than SLL but sufficiently high, based on the threshold of $F_2$, to avoid entering the conduction state simultaneous with $F_1$. This implies that the threshold of $F_1$ is greater than PV-SLL but less than PV. The threshold voltage of $F_1$ can be set, for example, to the pixel voltage PV minus one-half of SLL. As a non-limiting example, SLL can be equal to 1.8 volts, which is a common core logic value, with PV equal to 6 volts. In this case, the threshold voltage ($V_{gs}$) of $F_1$ can be approximately −5.0 volts. Thus, the switching point is set, at least approximately to 1.0 volt which facilitates noise immunity and low power consumption.

Still referring to FIG. 6, it should be appreciated that, in an embodiment, continuous interface/drive signals, corresponding to BLCLR and WL, can be provided to $F_3$ to maintain a current state of output $V_{out}$. In some embodiments, $F_3$ may not be needed and an input drive signal can be provided directly to a node 300 to maintain a current output of the $F_1/F_2$ inverter pair. In an embodiment, drive voltage that is provided by $F_3$ can charge the gate capacitances of $F_1$ and $F_2$ such that a current state of the $F_1/F_2$ inverter pair can be maintained once $F_3$ is switched off responsive to WL. In this way, pixel driver 100' can serve as a memory cell in the manner of pixel driver 100 of FIG. 4.

Having described pixel driver 100' above with respect to schematic details, further details will now be provided with respect to the operation of the pixel driver. When WL and BLCLR are concurrently driven at the SLL voltage, $F_3$ turns on which turns on $F_2$. The latter transistor then pulls an output $V_{out}$ effectively to ground along with electrode mirror EM, for example, to turn switch to or maintain an "OFF" state of the associated pixel. At the same time, SLL at the gate of $F_1$ results in a $V_{gs}$ voltage that is not of sufficient negative magnitude to exceed the threshold voltage of $F_1$ such that $F_1$ is in cutoff. When $F_3$ is deselected by word line WL, gate voltages for $F_1$ and $F_2$ can be maintained by gate capacitance at least for a period of time that is sufficient to reach the next selection of $F_3$ by WL during normal operation. When it is desired to set pixel driver 100' to the "ON" state, bit line BLCLR is set at least approximately to zero volts and WL is set to SLL such that the c1 terminal of $F_3$ serves as a source electrode and $F_3$ turns on to pull the gates of $F_1$ and $F_2$ toward ground. Once the gate voltage of $F_2$ drops below the threshold voltage of the transistor, $F_2$ enters cutoff. At the same time, the magnitude of $V_{gs}$ applied to $F_1$ increases and exceeds the threshold voltage of $F_1$ such that $F_1$ turns on, which pulls output $V_{out}$ at least approximately to pixel voltage PV along with electrode mirror EM to turn on the associated pixel. Again, gate capacitances can maintain drive voltages to the gates of $F_1$ and $F_2$ until the next selection of $F_3$ by WL. Thus, pixel driver 100' provides for operation with drive signals toggling between zero volts and SLL volts while producing an output that is operable between zero volts and pixel voltage PV while maintaining isolation of the drive signal lines from the pixel voltage. Isolation is provided by the gate terminals of $F_1$ and $F_2$ between node 300 and $V_{out}$ such that the control lines are not exposed to pixel voltage PV, irrespective of the state of the inverter pair. It is noted that pixel driver 100' does not utilize internal feedback signals such that no design consideration is required with respect to the possibility of an internal drive fight.

Figure 7:
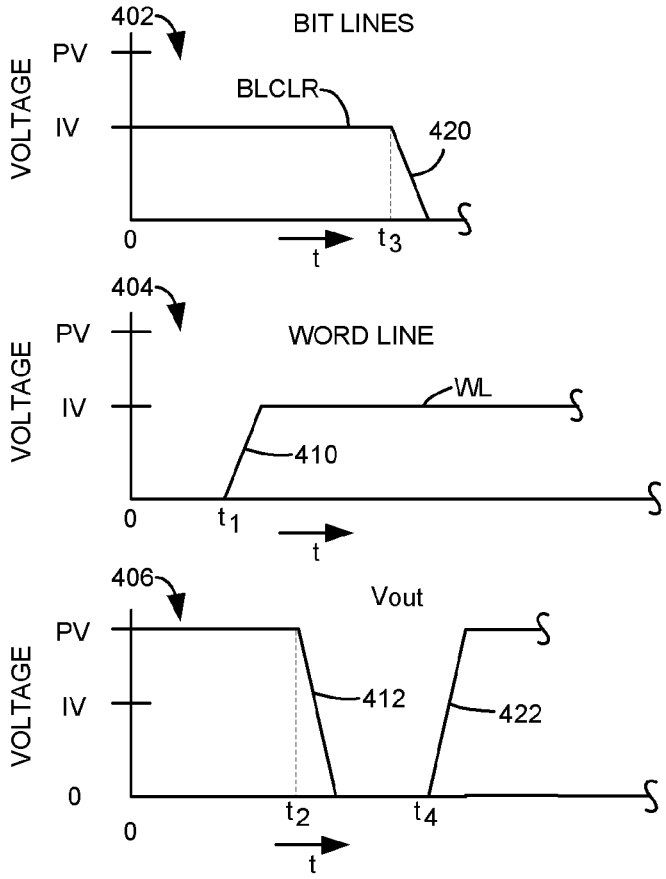
FIG. 7 is an embodiment of a timing diagram illustrating the operation of the pixel driver of FIG. 6.

Attention is now directed to FIG. 7 in conjunction with FIG. 6. The former illustrates an embodiment of a timing diagram generally indicated by the reference number 400, showing aspects of the operation of pixel driver 100' of FIG. 6. It should be appreciated that the various waveforms provided in the timing diagram are intended by way of example for purposes of enhancing the understanding of the reader and are not intended as limiting. The waveforms can vary in any suitable manner while remaining within the scope of the present disclosure. A first plot 402 illustrates bit line BLCLR versus time, a second plot 404 illustrates word line WL versus time and a third plot 406 illustrates output $V_{out}$ versus time wherein $V_{out}$ drives an electrode mirror (FIG. 6). Initially, BLCLR is at the intermediate voltage IV, WL is at zero volts and $V_{out}$ is at pixel voltage PV. At time $t_1$, WL is driven from zero volts to voltage IV in a transition 410. It is noted that the voltage at an inverter input node 300 will effectively follow BLCLR so long as WL remains at intermediate voltage IV because transistor $F_3$ can remain on. Responsive to transition 410, at $t_2$, $V_{out}$ at 412 from pixel voltage PV to zero volts, thereby switching the output from the high pixel drive voltage PV to a lower voltage of at least approximately zero volts. At $t_3$, BLCLR is driven from intermediate voltage IV to at least approximately zero volts in a transition 420. Since inverter input node 300 follows BLCLR when WL is at the intermediate voltage, at $t_4$, $V_{out}$ at 422 from zero volts to pixel voltage PV. Like the embodiment of FIG. 4, pixel driver 100' is operable based on control signals between a lower voltage (e.g., zero volts) and an intermediate voltage that is less than the pixel voltage while the output is operable between the lower voltage and the higher pixel voltage. The $V_{out}$ waveform 406 is an inverted version of BLCLR so long as WL is at the intermediate voltage, but with an upper limit of the pixel voltage.

Figure 8:
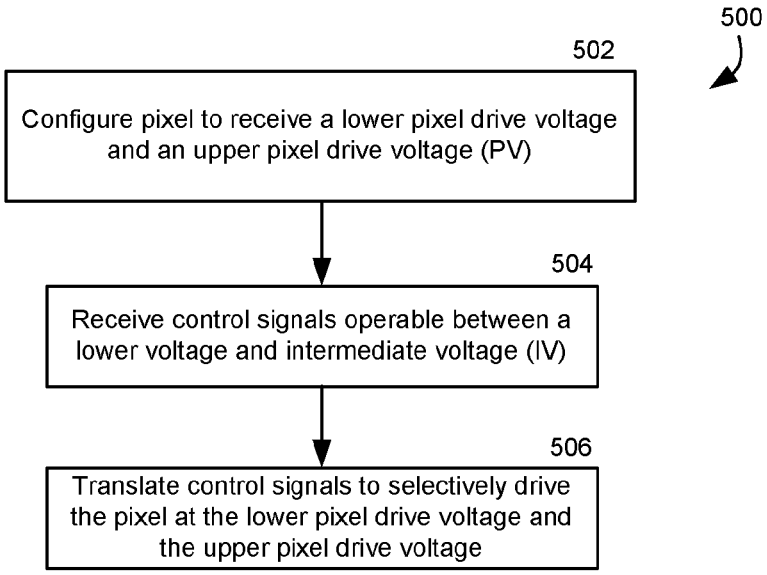
FIG. 8 is a flow diagram that illustrates an embodiment of a method of the present disclosure that can be applied to configurations of FIGS. 1-3, as well as to any suitable system.

Turning to FIG. 8, an embodiment of a method according to the present disclosure is generally indicated by the reference number 500. At 502, the method includes configuring a pixel, for example, of a microdisplay to receive a lower pixel drive voltage for one state of the pixel and an upper pixel drive voltage for an opposite state of the pixel. At 504, control signals are received, for example, by a pixel driver memory circuit, that are operable between a lower voltage (e.g., at least approximately zero volts) and an intermediate voltage that is less than the upper pixel drive voltage. At 506, the control signals are translated (e.g., converted) to selectively drive the pixel at the lower pixel drive voltage to produce one state of the pixel and the upper pixel drive voltage to produce the opposite state of the pixel. In an embodiment, a bit line serving as a control signal can be inverted to produce the pixel drive. Electrical isolation of control lines that carry the control signals can be provided.

In other embodiments, other forms of devices and/or systems can be provided which require a particular high logic level voltage for operation of the device and/or system. The driver can readily be configured to operate any suitable device or system based on such a particular high logic level voltage while accommodating interface lines that utilize a selected, intermediate logic level voltage that is less than the particular high logic level voltage such that the interface lines and associated circuitry that drive the interface lines is isolated from the particular high logic level voltage. The driver can be configured as a memory cell to maintain a current state of its outputs based on periodic drive signals such as, for example, in the context of driving a microdisplay.

While voltage conversion/level shifter embodiments and associated methods have been described above in the context of pixel drivers, it should be appreciated that the facilitation of moving at least some drive circuitry from a higher range of voltage toggling range to a lower voltage toggling range in any field of application can result a lower associated power consumption. In this regard, higher voltage transistors consume larger chip areas and exhibit larger spacing requirements from adjacent devices. Moreover, the greater the difference in magnitude between the two ranges, the greater the power savings can be. Further, active device area for circuitry that is transformed from operation at the high voltage toggling range to the low voltage toggling range can be beneficially reduced.

The foregoing description of the invention has been presented for purposes of illustration and description. It is not intended to be exhaustive or to limit the invention to the precise form or forms disclosed, and other modifications and variations may be possible in light of the above teachings wherein those of skill in the art will recognize certain modifications, permutations, additions and sub-combinations thereof.

What is claimed is:

1. A microdisplay system, comprising:

a microdisplay including a pixel configured to receive a lower pixel drive voltage for one state of the pixel and an upper pixel drive voltage for an opposite state of the pixel; and an eight transistor pixel driver circuit including first and second cross-coupled inverters forming a four transistor latch, the first inverter including a first inverter output and the second inverter including a second inverter output;

a BLCLR transistor in electrical communication with a word line and a BLCLR line to selectively output each of the lower pixel drive voltage and an intermediate voltage that is between the lower pixel drive voltage and the upper pixel drive voltage;

a BLSET transistor in electrical communication with the word line and a BLSET line to selectively output each of the lower pixel drive voltage and the intermediate voltage;

a first isolation transistor coupled between the BLCLR transistor and the first inverter to drive the first inverter at the lower pixel drive voltage to selectively produce the upper pixel drive voltage at the first inverter output of the first inverter in a first state of the four transistor latch and to electrically isolate the BLCLR transistor from the upper pixel drive voltage in the first state of the four transistor latch;

a second isolation transistor coupled between the BLSET transistor and the second inverter to drive the second inverter at the lower pixel drive voltage to selectively produce the upper pixel drive voltage at the second inverter output in a second state of the four transistor latch and to electrically isolate the BLSET transistor from the upper pixel drive voltage in the second state of the four transistor latch; and a selected one of the first and second inverter outputs electrically connected to the pixel.

* * * * *